United States Patent [19]

Sasaki et al.

[11] 3,994,058

[45] Nov. 30, 1976

[54] METHOD OF FIXING THE STARTING END PORTION OF A LINE TO BE WOUND UPON A REEL

[75] Inventors: Kichiro Sasaki, Takatsuki; Kazuo Takeuchi, Suita; Shiro Kazitani, Kobe; Kazuo Shimizu, Kobe; Etunori Matusima, Kobe, all of Japan

[73] Assignee: Kobe Steel Ltd., Kobe, Japan

[22] Filed: Feb. 24, 1975

[21] Appl. No.: 552,619

[30] Foreign Application Priority Data

Feb. 25, 1974 Japan ..... 49-22046

[52] U.S. Cl. ..... 29/428; 242/25 R; 242/125.1; 242/164

[51] Int. Cl.[2] ..... B23P 11/00; B65H 54/00; B65H 75/28

[58] Field of Search ..... 242/125, 125.1, 125.2, 242/74, 77, 77.3, 77.4, 159, 164, 25 R; 29/428, 433; 140/92.2

[56] References Cited

UNITED STATES PATENTS

| | | | |
|---|---|---|---|
| 1,901,949 | 3/1933 | Clark | 242/74 |
| 3,003,712 | 10/1961 | Dalton | 242/74 |
| 3,214,114 | 10/1965 | Wilson | 242/164 |
| 3,272,454 | 9/1966 | Lane et al. | 242/125.1 X |
| 3,586,258 | 6/1971 | Horlezeder | 242/74 X |

*Primary Examiner*—Stanley N. Gilreath
*Assistant Examiner*—John Jillions
*Attorney, Agent, or Firm*—Oblon, Fisher, Spivak, McClelland & Maier

[57] ABSTRACT

A method of fixing the starting end portion of a line, such as for example, a wire or the like, to a reel, such as for example, a bobbin, upon which the line is to be wound, characterized in that at least two bends are provided within the starting end portion of the line or the like, such that, assuming that the inflection disposed most remote from the tip of the starting end portion of the line to be the first inflection, at least a part of the line portion interposed between the tip of the starting end portion of the line and the first inflection will be disposed forwardly of the first inflection and oriented in the winding direction when the starting end portion of the line is inserted and fixed within a slot provided within the flange or drum portion of the reel.

4 Claims, 19 Drawing Figures

METHOD OF FIXING THE STARTING END PORTION OF A LINE TO BE WOUND UPON A REEL

BACKGROUND OF THE INVENTION

1. Field of the Invention

The present invention relates generally to a method of fixing the starting end portion of a line such as for example, a metal line, wire or the like, to the drum portion of a reel, such as for example, a bobbin, when winding the line upon the reel, and more particularly to a method which allows a considerable saving in the labor involved in such process and permits the line winding operation to be automatically accomplished.

2. Description of the Prior Art

Generally, when winding a line, such as for example, wire upon a reel, such as for example, a bobbin, the end of the line must be fixed to the winding head or other like portion of the revolving bobbin, however, the conventional line and fixing methods are characterized by various problems. In order to automatically fix the line end, it is generally endeavored to fix the line end to the winding head as it is virtually impossible to fix the line end directly to the bobbin. This method, however, necessitates a spring lock, terminal lock, or coil spring lock means in addition to other associated mechanisms for effecting the desired securement.

Alternatively, in the case of fixing the line end directly to the bobbin, the end portion of the line, such as for example, a wire W is plastically bent into the form of a hook as shown in FIG. 1 and then this portion is inserted and retained within a slot 4 formed within the cylindrical drum 2 of the bobbin 1 as shown in FIG. 2. According to this method, however, when the bobbin is rotated in order to start the winding of the line, the line portion W1 disposed forward of the bend point B could be bent back in the direction of the arrow, see FIG. 2, to the position shown by phantom line due to the tensile forces exerted upon the line, and as a result, the line end would often be dislocated or in fact removed from the slot making it impossible to effectively attain securement or fixing of the line end within the bobbin.

SUMMARY OF THE INVENTION

Accordingly, it is an object of the present invention to eliminate the aforenoted problems of conventional wire-winding starting methods.

Another object of the present invention is to provide a method for securely fixing the starting end portion of a line, such as for example, a wire, directly to a reel, such as for example, a bobbin.

Still another object of the present invention is to provide a method for fixing the starting end portion of a line, such as for example, a wire to a reel, such as for example, a bobbin so as to realize a considerable saving in labor and render the line winding operation automatic.

The foregoing and other objectives are achieved according to one embodiment of the present invention through the provision of a method for fixing the starting end portion of a line, such as for example, wire or the like to a reel upon which the line is to be wound characterized in that at least two inflections are provided within the starting end portion of the line such that, considering the inflection disposed most remote from the tip of the starting end portion of the line as the first inflection, at least a part of the line portion interposed between the tip of the starting end portion of the line and the first inflection will be disposed forwardly of the first inflection and in the line winding direction when the starting end portion of the line is inserted and fixed within a slot provided within the flange or drum portion of the reel.

According to a second embodiment of the present invention, there is provided a line end fixing method similar to that of the first embodiment and further characterized in that the starting end portion of the line is first guided into a guide channel within a guide member which is disposed close to the interior surface of the flange of the reel, the guide member being subsequently tilted or pivoted toward a slot or opening provided within the drum portion of the reel so as to insert the starting end portion of the line into the slot while holding the line within the guide member, and subsequently the reel is rotated simultaneously with the release of the starting end portion of the line by the guide member.

According to a third embodiment of the present invention, there is provided a line end fixing method which is also similar to that of the first embodiment and further characterized in that the starting end portion of the line is pertinently inflected by means of a bending device while the remaining line portion disposed rearwardly of the starting end portion is held in the winding direction by means of a wire holder, the starting end portion being orientated in the direction of the slot, which is provided at a proper position within the drum portion of the reel, by means of a pertinent guide mechanism, and subsequently, the starting end portion of the line is advanced toward the reel while maintaining the line holding condition, the wire being guided and inserted into the slot by means of the guide member.

BRIEF DESCRIPTION OF THE DRAWINGS

Various other objects, features and attendant advantages of the present invention will be more fully appreciated as the same becomes better understood from the following detailed description when considered in connection with the accompanying drawings, in which like reference characters designate like or corresponding parts throughout the several views and wherein.

DETAILED DESCRIPTION OF THE PREFERRED EMBODIMENTS

Figure 3:
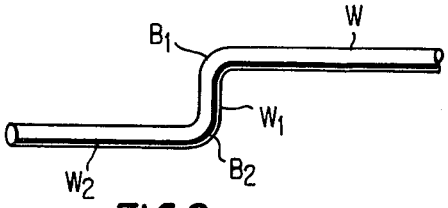
FIG. 3 is a sketch illustrating one configuration of a starting end portion of a line such as for example, a wire, configured in accordance with the method of the present invention.
Figure 4:
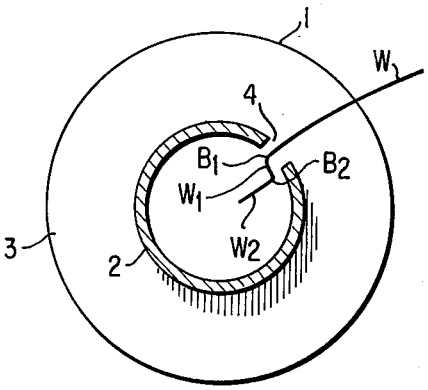
FIG. 4 is a view similar to that of FIG. 2 showing however the disposition of the line in accordance with the method of the present invention.
Figure 5:
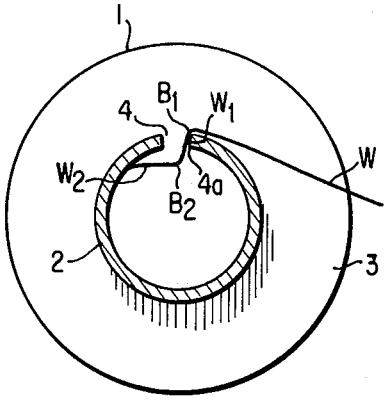
FIG. 5 is a view similar to that of FIG. 4 illustrating however the disposition of the line after rotation of the bobbin has commenced.

Referring now to the drawings and more particularly to FIGS. 3 through 5 thereof, the starting end portion of a metal line or wire W, which is to be wound upon a reel, such as for example, a bobbin 1, is plastically bent so as to form first and second inflections B1 and B2 which are oriented in the opposite directions with respect to each other, and subsequently this inflected portion of the wire is inserted into a cylindrical drum 2 of the bobbin 1 through means of a slot 4 formed within drum 2 so that the wire portion W1 intermediate the inflections B1 and B2 is contacted with and supported upon one end 4a of the drum 2 defining the slot 4 while the wire portion W2 disposed forward of the second inflection B2 abuts the inner surface of the drum 2.

Figure 1:
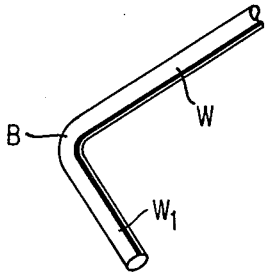
FIG. 1 is a perspective view of one conventional configuration of the starting end portion of a line, such as for example, a wire to be fixed to a bobbin by means of a conventional method.
Figure 2:
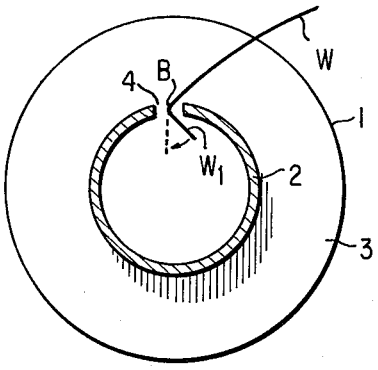
FIG. 2 is a radial cross-sectional view of a bobbin showing the condition wherein the starting end portion of the line shown in FIG. 1 has been inserted within a slot of a reel or bobbin.

Under these conditions, when the bobbin 1 is rotated in the direction of the arrow shown within FIG. 5 and tensile forces are applied to the wire W, there develops a torque which acts about the point of engagement P of the wire with the slot end 4*a*, whereby the wire portion disposed forward of the point of engagement P is urged upwardly until it is pressed against the interior surface of the drum 2, and consequently there is no possibility that the starting end portion of the wire is able to be dislocated from the slot end as is often experienced within conventional arrangements, such as for example, the arrangement shown in FIG. 2.

In other words, even when the torque load is applied to the wire W at the point of engagement P so as to urge the wire portion W1 interposed between the inflections B1 and B2 to somewhat spread, stretch, and flatten out, such spreading force is substantially arrested and counteracted as the end of the wire portion W2 disposed forwardly of the bend B2 is always in contact with the inner peripheral surface of the drum, the first inflection B1 therefore maintaining its initial bend angle, although a slight displacement could take place. Similarly, the second inflection B2 also maintains its original bend angle.

Figure 6:
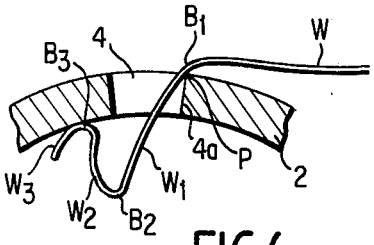
FIG. 6 is an enlarged partial cross-sectional view showing a modified form of the starting end portion of a line configured in accordance with the method of the present invention and also showing one way of inserting and fixing the line end within the reel slot.

Although two inflections are provided within the wire end portion as disclosed within the foregoing embodiment, three inflections may be provided as illustrated within the embodiment shown in FIG. 6. In this case, part of the end portion of the wire W is bent into the shape of a V so as to form the first, second and third inflections B1, B2, and B3, and the third inflection B3 is pressed against the interior surface of the drum 2 so as to thereby fix the wire end relative thereto. It is thus possible to provide two or more inflections as required.

In addition, it is also noted that the angular configuration of each inflection may be either acute or obtuse, or it may be arcuately shaped. In either case, it is essential that the wire end portion be deformed plastically and that at least a part of the wire portion situated forward of the first inflection be disposed forwardly in the winding direction. In the instance that only one inflection within the starting end portion of the wire is provided, upon insertion of such end portion of the wire into the slot of the drum or flange of the reel the same effect can be also obtained if the bent portion or inflection is slightly greater than the diameter or span of the slot because as the winding is commenced, another inflection is automatically formed by the engaging end of the slat.

Figure 7:
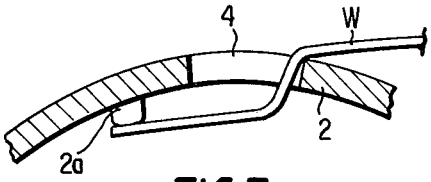
FIG. 7 is a view similar to that of FIG. 6 illustrating however another embodiment of apparatus which may be employed in accordance with the method of the present invention.

A still different embodiment of the present invention is shown in FIG. 7 wherein the foremost end of the wire W is forced against a projection 2*a*provided upon the inner surface of the drum 2 instead of having the wire end directly contact the inner surface of the drum.

Figure 8:
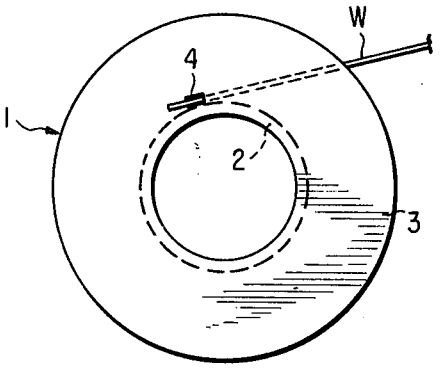
FIG. 8 is an end view of a bobbin showing still another embodiment of apparatus which may be employed in accordance with the method of the present invention.
Figure 9:
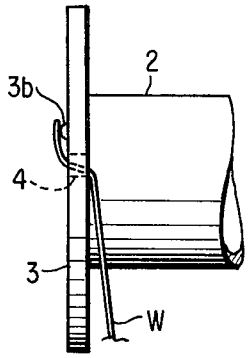
FIG. 9 is a side view of a bobbin showing yet another embodiment of apparatus which may be employed in accordance with the method of the present invention.
Figure 10:
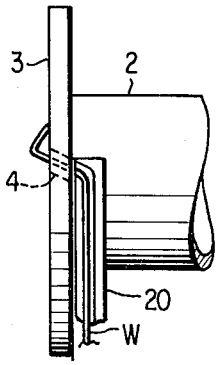
FIG. 10 is a view similar to that of FIG. 9 showing however a further embodiment of apparatus which may be employed in accordance with the method of the present invention.

In still another embodiment of the present invention as shown in FIG. 8, a fixing slot 4 is provided in the radially extending flange 3 of the bobbin 1 and the duly inflected end portion of the wire W is passed through slot 4 from the axially interior side of the flange to the axially exterior side of the flange and the same is secured against the external surface of the flange. In this case, as within the embodiment of FIG. 7, a projection 3*b* may be provided upon a pertinent portion of the external surface of the flange 3 so that the wire end is pressed against such projection as shown in FIG. 9.

Figure 14:
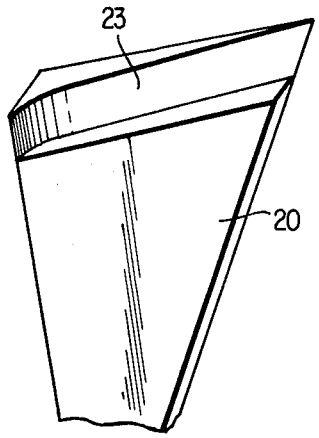
FIG. 14 is a perspective view showing a modified form of a guide member which may be used within the apparatus of FIG. 11.

Yet another embodiment of the present invention is disclosed within FIGS. 10-14 wherein the slot 4 is provided within a portion of the flange 3 that is disposed adjacent the drum 2. In this case, the fixation of the wire end can be facilitated by using a guide member 20 having a curved side wall 23 with its curvature directed toward the inner radially extending surface of the flange 2 as best shown in FIG. 14. That is, the starting end portion of the wire W is guided along the curved side wall 23 of the guide member 20 by advantageously utilizing the elasticity of the wire W and subsequently inserting the same into the slot 4 so as to thereby fix the wire end portion to the bobbin.

Figure 11:
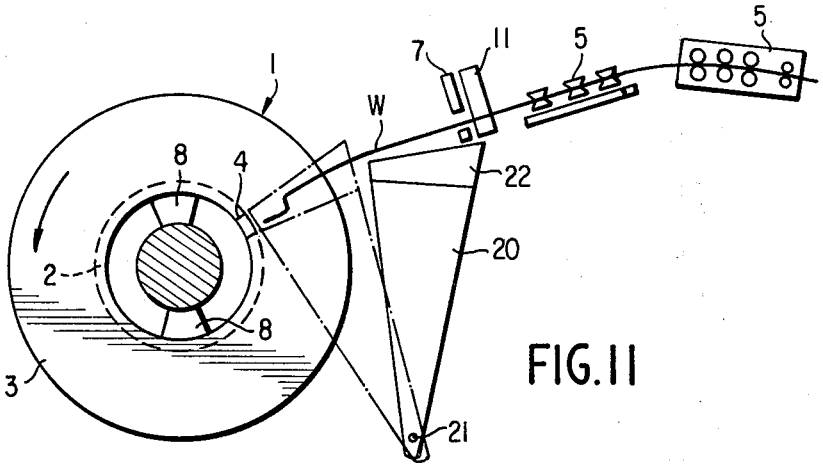
FIG. 11 is a schematic drawing showing the apparatus of FIG. 10 as well as additional apparatus which may be used for practicing the method of the present invention.

The actual winding of a wire W upon a reel 1 is best appreciated with reference to FIG. 11. The reel or bobbin 1 is arranged such that it is rotatable about the axial portion thereof through means of reel fixing elements 8, and is disposed such that a slot or opening 4 provided within the drum 2 will be located at a predetermined angular position. The wire W is fed to the reel 1 through means of guide rollers 5 and the wire W is able to be cut by means of a cutter 7. The starting end portion of the wire is bent into a predetermined shape such as for example, that shown within FIG. 3 by means of a bending device 11 and is also adapted to be guided by means of a guide member 20 toward the opening 4 provided within the drum 2, the guide member 20 having the guide channel 22 and being tiltable or pivotable about a pivot pin 21.

Figure 12A:
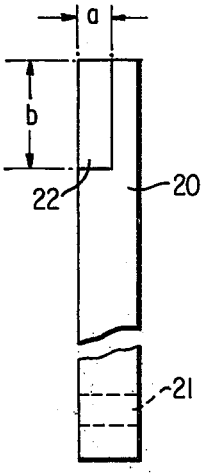
FIGS. 12*a*–12*d* are schematic drawings illustrating different forms of guide members which may be used within the apparatus of FIG. 11.
Figure 12B:
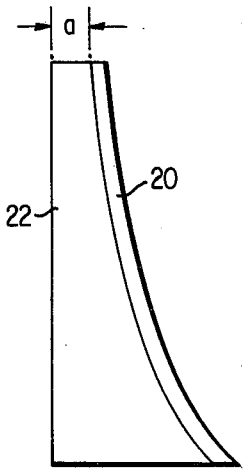

Different embodiments of guide members 20 which may be employed within the apparatus of FIG. 11 are shown in FIG. 12 and it is to be noted that if the dimensions *a* and *b* of the guide channel 22 are properly adjusted as shown for example in FIG. 12*a*, it is possible to securely guide and insert the starting end portion of the wire into the reel opening 4 irrespective of the size of the wire or the dimensions of the inflections at the starting end portion of the wire. The guide member 20 needn't be moved synchronously with the wire feed apparatus, but alternatively, the wire end may be previously disposed relative to guide 20 at a certain predetermined position and subsequently fed. For this purpose, the guide member 20 is provided with the guide channel 22 which has a divergent end portion configured like a funnel.

Figure 12C:
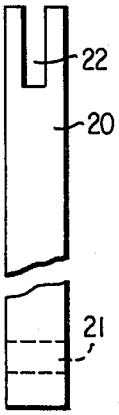
Figure 12D:
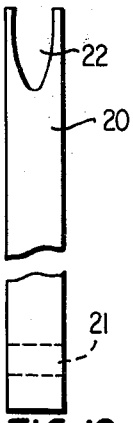
Figure 13:
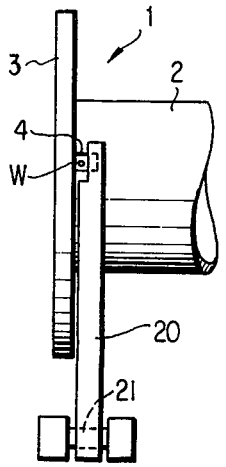
FIG. 13 is a view similar to that of FIG. 10 illustrating however the relative arrangement of the reel and guide member within the apparatus of FIG. 11.

The use of a guide member 20 having a U-shaped guide channel 22, such as for example, shown in FIGS. 12*c* and 12*d* makes it possible to insert the starting end of the wire while simultaneously properly holding and guiding it, into the opening provided within the drum portion of the reel with no need of providing a wire holder. The relative arrangement of the reel 1 and the guide member 20 for guiding the wire W into the opening 4 provided within the drum 2 at a position adjacent the flange 3 of the reel 1 is illustrated within FIG. 13.

An example of winding apparatus which may be employed for practicing the method of the present invention will now be described with particular reference being made to FIGS. 15 and 16 wherein a wire holder generally indicated by the reference character WH is adapted to hold the major portion of the metal line or wire W. This wire holder WH comprises a pair of axially opposed holding rollers 25 and 26, with one of said rollers 25 being fixedly secured to a movable frame 27 while the other roller 26 is secured to a piston of a fluid pressure cylinder 28 mechanism which is also mounted upon frame 27 such that roller 26 is movable toward or away from roller 25. There is also provided a guide roller 24 which is adapted to securely guide the wire W to the space defined between holding rollers 25 and 26 so as to pass through the axis of such rollers.

A traverse mechanism 29 comprises a traverser 31 which is reciprocatable upon a mount 30 in a direction which is transverse to the wire feeding direction through means of a driving means, not shown, and this traverser 31 is provided with a guide rail 9 which extends in the wire feeding direction and upon which the movable frame 27 of the wire holder WH is supported so as to be movable in the wire feeding direction. The traverse mechanism is operated by means of a fluid pressure cylinder 33 which is provided in the rear of the traverser 31.

Figure 16:
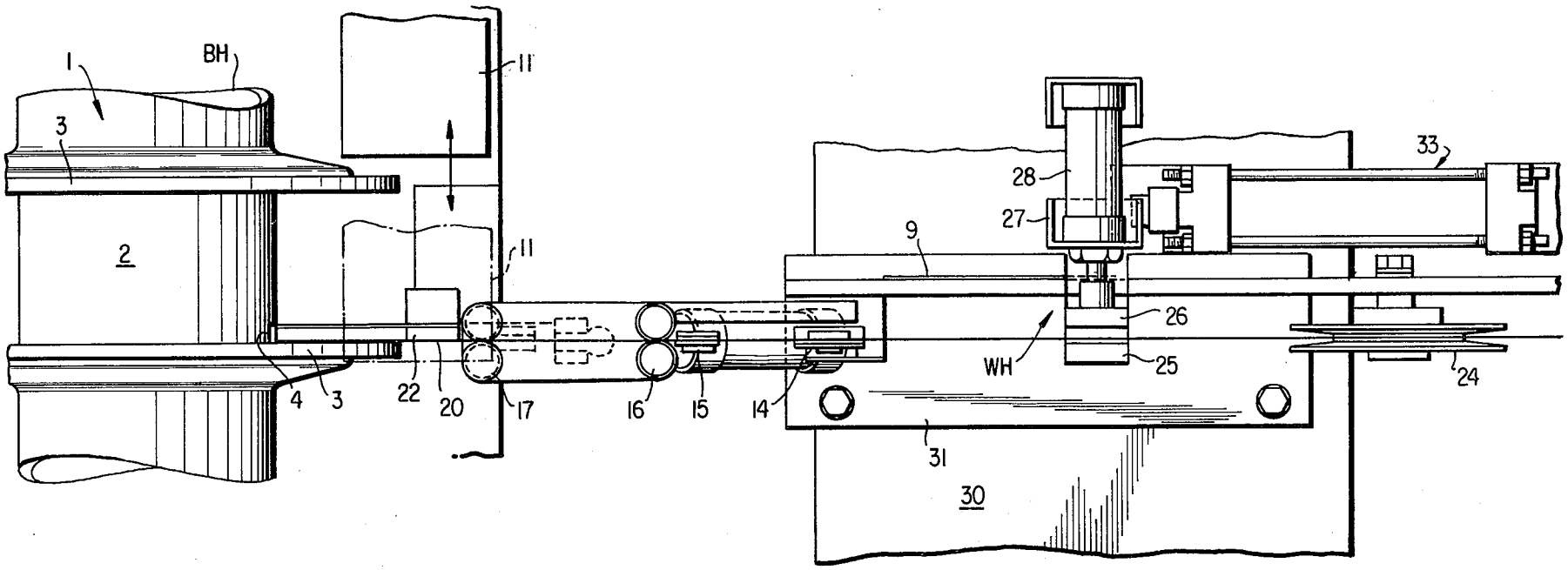
FIG. 16 is a plan view of the system apparatus shown in FIG. 15.

A wire end bending device generally indicated by the reference character 11 comprises a receiving die 11a and a pressing die 11b which are designed for bending the starting end portion of the wire into a shape, such as for example, that shown in FIG. 3, and although the driving means for bending device 11 is not shown, this device is normally placed at a position outside of the reel 1 and, in operation, is movable from this position to a position shown by the phantom lines in FIG. 16. The bending device 11 is also provided with a cutter for cutting the end of the wound-up wire, the cutting being able to be effected simultaneously with the bending operation at the end of the die assembly.

A mechanism generally indicated by the reference character 13 is also provided for orientating the starting end portion of the wire, this mechanism comprising a rocker arm 18 having a plurality of wire retaining rollers 14, 15 16, and 17 and arranged so as to be pivoted through a suitable angular displacement by means of a fluid pressure clyinder 19 interposed between the traverser 31 of the traverse mechanism 29 and the rocker arm 18 so as to direct the starting end portion of the wire toward the opening 4 formed within the drum 2 of the reel 1.

The guide member 20 is of course provided for positively guiding the wire end, which has been properly orientated by orientating mechanism 13, toward the opening 4 and it is apparent that guide member 20 is pivotable in front of the reel 1 and is disposed at a position close to the inner surface of the flange 3, member 20 being arranged to be tilted by means of a fluid pressure cylinder 32. With this guide member being tilted or pivoted to a predetermined position relative to the reel, the starting end portion of the wire is guided, while held by guide channel 22 and flange 3, and inserted into the opening 4.

The operation of the wire winding apparatus including the above-described wire end fixing device will now be discussed. Firstly, an empty bobbin 1 is set in position upon mount or support structure 34 by means of bobbin holders BH which are connected to a driving means, not shown, and subsequently, a wire W is led into the apparatus from the right side or direction as seen in FIGS. 15 and 16. The wire W is first passed around the guide roller 24 upon the traverser 31 and then between the holding rollers 25 and 26 of the wire holder WH, the holding rollers 25 and 26 being maintained separated from each other during this time. The wire is then passed around the retaining rollers 14, 15, 16 and 17 disposed upon the rocker arm 18 so that the wire end, that is, the starting end portion of the wire, extends forwardly from the rocker arm 18.

At this stage, the bending device 11, which has remained at the position denoted by the solid lines in FIG. 16, is now moved laterally to the position denoted by the phantom lines and the starting end portion of the wire is then inserted into the bending device. Concurrently therewith the wire holder WH is operated so as to securely hold the remaining portion of the wire through means of the holding rollers 25 and 26, and subsequently an actuating cylinder 12 is operated so as to thereby bend the starting end portion of the wire into the predetermined shape. Upon completion of the inflection of the wire end, the bending device 11 is returned to its original position and the cylinder 19 of the wire end orientating mechanism 13 and the cylinder 32 are operated so as to respectively pivot the rocker arm 18 and guide member 20 into the respective positions shown by the phantom lines. At such time, the slot or opening 4 within drum 2 of bobbin 1 is located at an aligned position with respect to the tilted position of guide member 20.

Figure 15:
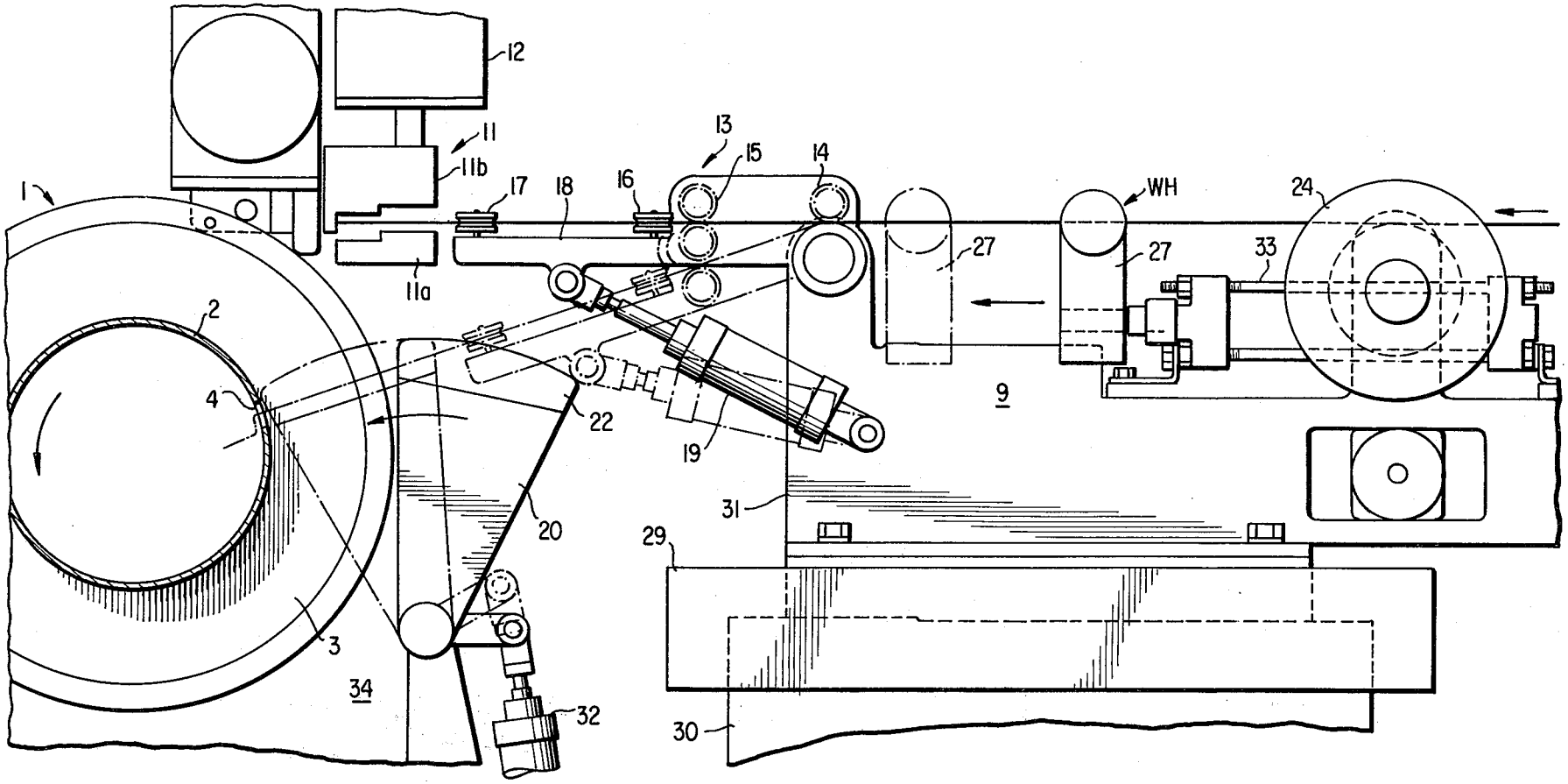
FIG. 15 is a side elevation view showing one embodiment of the entire system apparatus for practicing the method of the present invention.

After the starting end portion of the wire has been properly guided to the opening 4, the cylinder 33 is operated so as to advance the wire holder WH to the position denoted by the phantom lines of FIG. 15, whereby the wire is moved forwardly with the major part thereof being fixed held by the holding rollers, and consequently, the starting end portion thereof is guided by means of the guide channel 22 of guide member 20 and properly inserted into opening 4. Thereafter, the bobbin holders BH are rotated so as to rotate bobbin 1 in the direction of the arrow shown in FIG. 15, whereby the starting end portion of the wire is fixed within the interior portion of drum 2 through the opening 4. Simultaneously with the rotation of the bobbin, the traverse mechanism 29 is operated so as to reciprocate the traverser 31 at a predetermined speed and with a stroke corresponding to the length of the drum 2 of the bobbin 1 and consequently, the wire is successively wound upon the drum.

Thus, it may be seen that the method of the present invention has important advantages over the known prior art in that proper insertion into a fixing opening for fixing the starting end portion of a wire or such, which is to be wound upon a reel, can be quickly and securely accomplished. More particularly, as the major portion of the wire is securely held by holding means before bending the starting end portion of the wire, there is no possibility that the wire could become loose or disorderly so as to hinder the continuous winding operation. The conventional methods were unable to realize the perfect automation of the winding operation and hence necessitated very inefficient auxiliary manual operations, however the method of the present invention facilitates the secure and perfectly automatic winding of the wire in a very simple manner. Thus, the present invention has extremely high economical value.

Obviously, many modifications and variations of the present invention are possible in light of the above teachings. It is to be understood therefore that within the scope of the appended claims the present invention may be practiced otherwise than as specifically described herein.

What is claimed as new and desired to be secured by Letters Patent of the United States is:

1. A method of fixing the wind-starting end portion of a metal wire to the drum portion of a reel within a continuous and automatic winding process comprising the steps of:

cutting the end of a wound-up wire of a preceding reel, and simultaneously therewith, plastically bending said wind-starting end of said wire so as to form at least two inflections within said wind-starting end portion of said wire such that, considering the inflection positioned most remote from the tip of said wind-starting end portion of said wire to be the first inflection, at least a part of said wire interposed between said tip of said wire end portion and said first inflection will be disposed forward of said first inflection and oriented in the wire winding direction;

guiding said bent wind-starting end portion of said wire into an opening formed within the drum portion of said reel and subsequently inserting said starting end portion of said wire into said opening while fixedly holding said wire at the rear portion thereof; and slightly rotating said reel simultaneously with the release of said rear portion of said wire so as to thereby securely fix said wind-starting end portion of said wire within said reel.

2. A line end fixing method according to claim 1, further comprising:

guiding said starting end portion of said wire to a guide channel of a guide member provided adjacent to the inner side of the reel flange; and pivoting said guide member toward said wire end insertion opening provided within the drum portion of said reel so as to facilitate insertion of said starting end portion of said wire into said opening while properly holding said wire end by said guide channel.

3. A line end fixed method according to claim 1, further comprising:

orienting said starting end portion of said wire by a wire end orientating mechanism in the direction of said opening provided at a predetermined position in the drum portion of said reel; and, advancing said wire, while held by a wire holder, toward said reel so that said starting end portion thereof is guided and inserted into said opening by a guide member and thereby fixing said wire within said reel.

4. A line end fixing method according to claim 3, wherein:

said reel is a bobbin.

* * * * *